US010987729B2

(12) United States Patent
Sunakawa

(10) Patent No.: US 10,987,729 B2
(45) Date of Patent: Apr. 27, 2021

(54) FE-BASED AMORPHOUS ALLOY RIBBON MANUFACTURING METHOD, FE-BASED AMORPHOUS ALLOY RIBBON MANUFACTURING DEVICE, AND WOUND BODY OF FE-BASED AMORPHOUS ALLOY RIBBON

(71) Applicant: HITACHI METALS, LTD., Tokyo (JP)

(72) Inventor: Jun Sunakawa, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/485,738

(22) PCT Filed: Feb. 14, 2018

(86) PCT No.: PCT/JP2018/005129

§ 371 (c)(1),
(2) Date: Aug. 13, 2019

(87) PCT Pub. No.: WO2017/151172

PCT Pub. Date: Aug. 23, 2018

(65) Prior Publication Data

US 2019/0358699 A1 Nov. 28, 2019

(30) Foreign Application Priority Data

Feb. 14, 2017 (JP) ..... JP2017-025175

(51) Int. Cl.
*B22D 11/06* (2006.01)
*B22D 11/12* (2006.01)
(Continued)

(52) U.S. Cl.
CPC ..... *B22D 11/0611* (2013.01); *B22D 11/12* (2013.01); *C22C 45/02* (2013.01);
(Continued)

(58) Field of Classification Search
None
See application file for complete search history.

(56) References Cited

U.S. PATENT DOCUMENTS

2003/0041931 A1 3/2003 Sunakawa et al.
2010/0132907 A1* 6/2010 Ozaki ..... B22D 11/0674 164/122

(Continued)

FOREIGN PATENT DOCUMENTS

CN 103348420 A 10/2013
CN 105074841 A 11/2015

(Continued)

OTHER PUBLICATIONS

Extended European Search Report dated Jul. 21, 2020 in corresponding European Patent Application No. 18754914.2.

(Continued)

*Primary Examiner* — George Wyszomierski
(74) *Attorney, Agent, or Firm* — Westman, Champlin & Koehler, P.A.

(57) ABSTRACT

A method of manufacturing an Fe-based amorphous alloy ribbon includes forming a coated film of a molten alloy on a peripheral surface of a chill roll that has been subjected to polishing using a polishing brush roll, cooling the coated film on the peripheral surface, and then winding the Fe-based amorphous alloy ribbon, which has been peeled off by a peeling means, on a wind-up roll, to obtain a wound body of an Fe-based amorphous alloy ribbon.

The polishing brush roll includes a roll axis member and a polishing brush that is equipped with a plurality of brush bristles and satisfies the following condition (1) and condition (2) while rotating axially in a reverse direction to the chill roll.

Condition (1): Free length of brush bristles is more than 30 mm but no more than 50 mm.

Condition (2): Density of brush bristles at the brush bristle tip is more than 0.30 bristles/mm$^2$ but no more than 0.60 bristles/mm$^2$.

6 Claims, 1 Drawing Sheet

(51) Int. Cl.
*C22C 45/02* (2006.01)
*H01F 1/153* (2006.01)

(52) U.S. Cl.
CPC ..... *H01F 1/15341* (2013.01); *C22C 2200/02* (2013.01); *C22C 2202/02* (2013.01)

(56) References Cited

U.S. PATENT DOCUMENTS

| | | | |
|---|---|---|---|
| 2013/0314198 | A1 | 11/2013 | Yoshizawa et al. |
| 2015/0027592 | A1 | 1/2015 | Shibasaki et al. |
| 2015/0050510 | A1 | 2/2015 | Montegi et al. |
| 2016/0035474 | A1 | 2/2016 | Azuma et al. |

FOREIGN PATENT DOCUMENTS

| | | | | |
|---|---|---|---|---|
| JP | 07178516 | A | | 7/1995 |
| JP | 2002321042 | A | * | 11/2002 |
| JP | 2002321042 | A | | 11/2002 |
| WO | 2012/102379 | A1 | | 8/2012 |
| WO | 2017/090402 | A1 | | 6/2017 |

OTHER PUBLICATIONS

Chinese Office Action dated Nov. 3, 2020 in corresponding Chinese Patent Application No. 201880011690.7. English translation.
Bizen, Standard Test Method for Lamination Factor of Amorphous Magnetic Strip, ASTM International Designation A900/A900M-01 (2006), 4 pages.

* cited by examiner

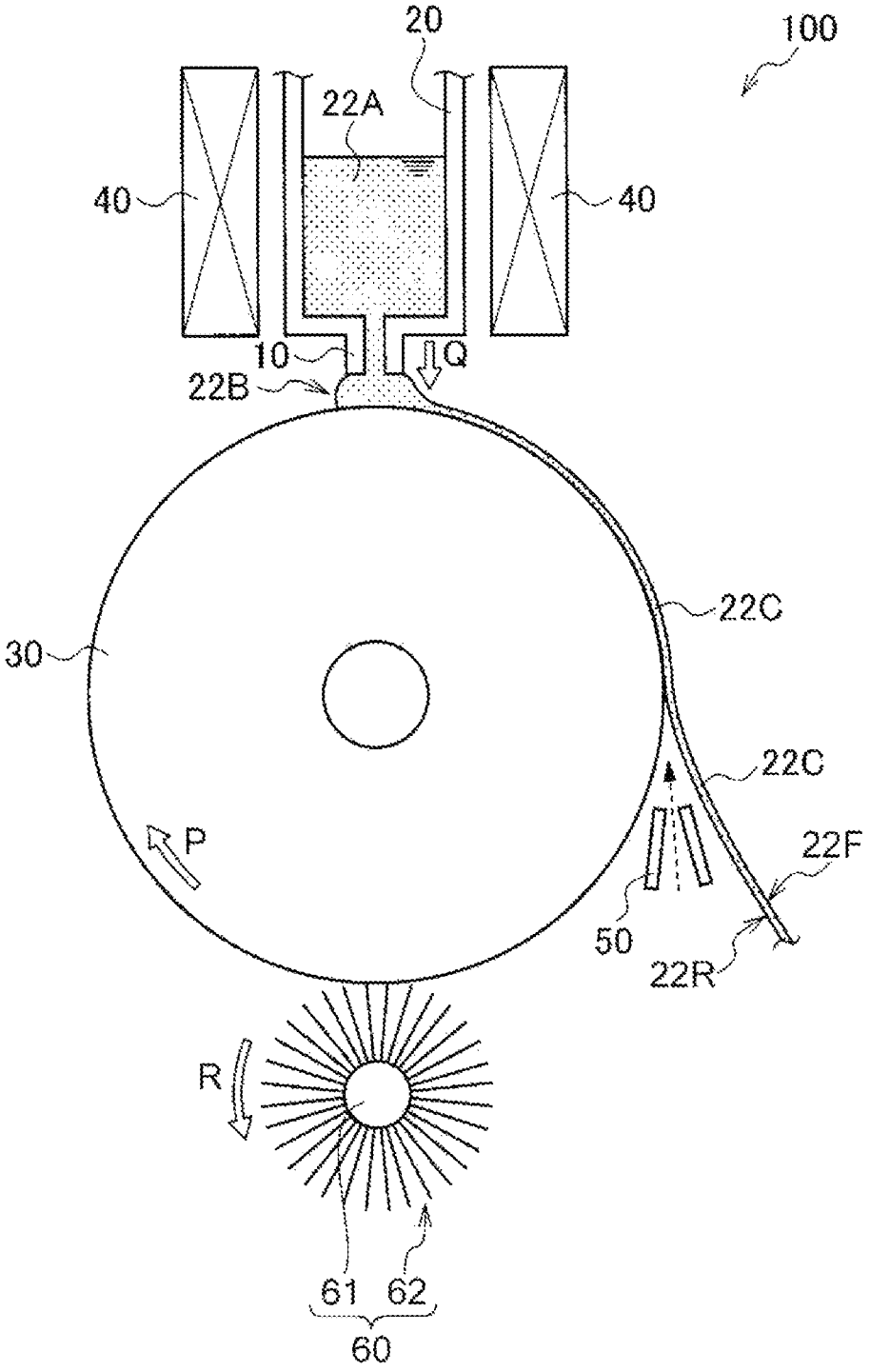
20
100
22A
40
40
10
Q
22B
22C
30
22C
P
22F
50
22R
R
61
62
60

FE-BASED AMORPHOUS ALLOY RIBBON MANUFACTURING METHOD, FE-BASED AMORPHOUS ALLOY RIBBON MANUFACTURING DEVICE, AND WOUND BODY OF FE-BASED AMORPHOUS ALLOY RIBBON

TECHNICAL FIELD

The present disclosure relates to an Fe-based amorphous alloy ribbon manufacturing method, an Fe-based amorphous alloy ribbon manufacturing device, and a wound body of an Fe-based amorphous alloy ribbon.

BACKGROUND ART

Fe-based amorphous alloy ribbon (Fe-based amorphous alloy thin strip) is becoming more popular as a material for an iron core of a transformer.

As an example of an Fe-based amorphous alloy ribbon, a rapidly quenched Fe soft magnetic alloy thin strip having waveform unevenness on a free surface, the waveform unevenness having width direction troughs arranged at approximately regular intervals in the longitudinal direction, wherein the mean amplitude of the troughs is 20 mm or less, is known (see, for example, Patent Document 1).

Patent Document 1: International Publication WO 2012/102379

SUMMARY OF INVENTION

Technical Problem

A wound body of an alloy ribbon is produced by discharging a molten alloy onto a chill roll to form an Fe-based amorphous alloy ribbon, and then winding the resulting Fe-based amorphous alloy ribbon on a wind-up roll.

This wound body is used, for example, for production of an iron core (core), and the like. However, when starting to pull out and unwind an alloy ribbon from a wound body, the wound body may collapse (unwinding collapse), and the wound body may assume a state in which it is impossible to extract the alloy ribbon.

Further, there is a case of preparing plural wound bodies (for example, 5 wound bodies), unwinding alloy ribbons from these wound bodies, disposing the alloy ribbons one on another in plural layers (for example, 5 layers), and then performing rewinding, thereby producing a layered wound body (a laminate wound body). However, also in this case, similarly to the above, when starting to pull out and unwind an alloy ribbon from a wound body, the wound body may collapse (unwinding collapse), so that a layered wound body cannot be produced.

In addition, there is a phenomenon in which a space factor becomes low from the early stage of the production of an Fe-based amorphous alloy ribbon that is produced continuously.

Accordingly, an Fe-based amorphous alloy ribbon manufacturing method has been required, with which a wound body can be produced in which the occurrence of unwinding collapse is suppressed, and a wound body having a high space factor from the early stage of production can be obtained.

The present disclosure is made in consideration of the forgoing, and it is an object of the present disclosure to provide an Fe-based amorphous alloy ribbon manufacturing method, with which a wound body can be obtained in which the occurrence of unwinding collapse is suppressed, and a high space factor is achieved from the early stage of production.

Solution to Problem

After diligently studying the problems, the present inventors have found that, in discharging a molten alloy onto a chill roll to form an Fe-based amorphous alloy ribbon and then winding the resulting Fe-based amorphous alloy ribbon on a wind-up roll, the conditions for polishing the chill roll have correlation with the occurrence of unwinding collapse in the wound body. Based on this finding, the present disclosure has been accomplished.

Namely, specific means for addressing the above problems are as follows.

<1> A method of manufacturing an Fe-based amorphous alloy ribbon, the method using an Fe-based amorphous alloy ribbon manufacturing device equipped with:

a chill roll in which a coated film of a molten alloy that is a source material for an Fe-based amorphous alloy ribbon is formed on the peripheral surface and the coated film is cooled on the peripheral surface to form an Fe-based amorphous alloy ribbon, a molten metal nozzle that discharges the molten alloy toward the peripheral surface of the chill roll, a peeling means that peels off the Fe-based amorphous alloy ribbon from the peripheral surface of the chill roll, a wind-up roll for winding the Fe-based amorphous alloy ribbon that has been peeled off, and a polishing brush roll, which includes a roll axis member and a polishing brush that is equipped with plural brush bristles and is placed around the roll axis member, satisfies the following condition (1) and condition (2), is provided between the peeling means and the molten metal nozzle in the periphery of the chill roll, and is used for polishing by bringing the polishing brush into contact with the peripheral surface of the chill roll while rotating axially in the reverse direction to the chill roll; wherein the method includes forming a coated film of the molten alloy on the peripheral surface of the chill roll that has been subjected to polishing by using the polishing brush roll, then cooling the coated film on the peripheral surface, and then winding the Fe-based amorphous alloy ribbon, that has been peeled off by the peeling means, on the wind-up roll, to obtain a wound body of an Fe-based amorphous alloy ribbon.

Condition (1): Free length of brush bristles is more than 30 mm but 50 mm or less.

Condition (2): Density of brush bristles at the brush bristle tip is more than 0.30 bristles/mm$^2$ but 0.60 bristles/mm$^2$ or less.

<2> The method of manufacturing an Fe-based amorphous alloy ribbon according to <1>, wherein when 20 sheets of early stage alloy ribbon samples each having a strip shape, in which the width direction in the Fe-based amorphous alloy ribbon corresponds to the long side and the longitudinal direction in the Fe-based amorphous alloy ribbon corresponds to the short side, are obtained by continuously cutting every 20 mm toward the longitudinal direction to cut out 20 sheets of samples from a range of the Fe-based amorphous alloy amorphous ribbon that has been produced continuously, the range being a range produced within a time period of from 5 minutes to 7 minutes after the start of production, a space factor $LF_{[S]}$ in the early stage alloy ribbon samples is from 87% to 94%, and $WC_{[S]}$ which is measured according to the following method with regard to a layered body prepared by disposing 20 sheets of the early stage alloy ribbon samples, one on another in layers, is from 5 μm/20 sheets to 40 μm/20 sheets, and when 20 sheets of end stage alloy ribbon samples having a strip shape, in which a width direction in the Fe-based amorphous alloy ribbon corresponds to a long side and a longitudinal direction in the Fe-based amorphous alloy ribbon corresponds to a short side, are obtained by continuously cutting every 20 mm toward the longitudinal direction to cut out 20 sheets of samples from a range of the Fe-based amorphous alloy amorphous ribbon that has been produced continuously, the range being a range of 1 m from the last end formed at the time of finishing the production, a rate of change $(LF_{[E]}-LF_{[S]})/LF_{[S]}\times100$ in a space factor $LF_{[E]}$ in the end stage alloy ribbon samples from the above space factor $LF_{[S]}$ is ±2% or less, and a rate of change $(WC_{[E]}-WC_{[S]})/WC_{[S]}\times100$ in $WC_{[E]}$, which is measured according to the following method with regard to a layered body prepared by disposing 20 sheets of the end stage alloy ribbon samples, one on another in layers, from the above $WC_{[S]}$ is from −12% to +80%, and in measurement of a wedge coefficient (WC), with regard to each of one end IB and another end OB in a long side direction in a layered body prepared by disposing, one on another in layers, 20 sheets of alloy ribbon samples each having a strip shape, the thicknesses of three points in a range of from 0 mm to 16 mm from the end, a range of from 10 mm to 26 mm from the end, and a range of from 20 mm to 36 mm from the end are measured by using a micrometer employing an anvil having a diameter of 16 mm. The greater one of the difference between the maximum value $IB_{max}$ of one end side and the minimum value $OB_{min}$ of the other end side and the difference between the minimum value $IB_{min}$ of one end side and the maximum value $OB_{max}$ of the other end side is taken as WC. WC measured with regard to the early stage alloy ribbon samples is taken as $WC_{[S]}$, and WC measured with regard to the end stage alloy ribbon samples is taken as $WC_{[E]}$.

<3> The method of manufacturing an Fe-based amorphous alloy ribbon according to <1> or <2>, wherein the Fe-based amorphous alloy ribbon consists of Fe, Si, B, C, and impurities, and a content of Si is from 1.8 atom % to 4.2 atom %, a content of B is from 13.8 atom % to 16.2 atom %, and a content of C is from 0.05 atom % to 0.4 atom % when a total content of Fe, Si, B, C, and impurities is 100 atom %.

<4> The method of manufacturing an Fe-based amorphous alloy ribbon according to <3>, wherein the content of Si is from 2 atom % to 4 atom %, the content of B is from 14 atom % to 16 atom %, and the content of C is 0.2 atom % to 0.3 atom % when the total content of Fe, Si, B, C, and impurities is 100 atom %.

<5> A wound body of an Fe-based amorphous alloy ribbon in which an Fe-based amorphous alloy ribbon that has been produced continuously is wound on one or plural wind-up rolls, wherein when 20 sheets of early stage alloy ribbon samples each having a strip shape, in which a width direction in the Fe-based amorphous alloy ribbon corresponds to a long side and a longitudinal direction in the Fe-based amorphous alloy ribbon corresponds to a short side, are obtained by continuously cutting every 20 mm toward the longitudinal direction to cut out 20 sheets of samples from a range of the Fe-based amorphous alloy amorphous ribbon, the range being a range of from 3000 m to 4200 m from the end on the winding start side in the wound body, a space factor $LF_{[S]}$ in the early stage alloy ribbon samples is from 87% to 94%, and $WC_{[S]}$ which is measured according to the following method with regard to a layered body prepared by disposing 20 sheets of the early stage alloy ribbon samples, one on another in layers, is from 5 μm/20 sheets to 40 μm/20 sheets, when 20 sheets of end stage alloy ribbon samples having a strip shape, in which a width direction in the Fe-based amorphous alloy ribbon corresponds to a long side and a longitudinal direction in the Fe-based amorphous alloy ribbon corresponds to a short side, are obtained by continuously cutting every 20 mm toward the longitudinal direction to cut out 20 sheets of samples from a range of the Fe-based amorphous alloy amorphous ribbon, the range being a range of 1 m from the end on the winding finish side in the wound body, a rate of change $(LF_{[E]}-LF_{[S]})/LF_{[S]}\times100$ in a space factor $LF_{[E]}$ in the end stage alloy ribbon samples from the above space factor $LF_{[S]}$ is ±2% or less, and a rate of change $(WC_{[E]}-WC_{[S]})/WC_{[S]}\times100$ in $WC_{[E]}$, which is measured according to the following method with regard to a layered body prepared by disposing 20 sheets of the end stage alloy ribbon samples, one on another in layers, from the above $WC_{[S]}$ is from −12% to +80%, and in measurement of a wedge coefficient (WC), with regard to each of one end IB and the other end OB in the long side direction in a layered body prepared by disposing, one on another in layers, 20 sheets of alloy ribbon samples each having a strip shape, the thicknesses of three points in a range of from 0 mm to 16 mm from the end, a range of from 10 mm to 26 mm from the end, and a range of from 20 mm to 36 mm from the end are measured by using a micrometer employing an anvil having a diameter of 16 mm, a greater one of the difference between the maximum value $IB_{max}$ of one end side and the minimum value $OB_{min}$ of the other end side, or a difference between the minimum value $IB_{min}$ of one end side and the maximum value $OB_{max}$ of the other end side, is taken as WC, WC measured with regard to the early stage alloy ribbon samples is taken as $WC_{[S]}$, and WC measured with regard to the end stage alloy ribbon samples is taken as $WC_{[E]}$.

<6> An Fe-based amorphous alloy ribbon manufacturing device equipped with:

a chill roll in which a coated film of a molten alloy that is a source material for an Fe-based amorphous alloy ribbon is formed on the peripheral surface and the coated film is cooled on the peripheral surface to form an Fe-based amorphous alloy ribbon, a molten metal nozzle that discharges the molten alloy toward the peripheral surface of the chill roll, a peeling means that peels off the Fe-based amorphous alloy ribbon from the peripheral surface of the chill roll, a wind-up roll for winding the Fe-based amorphous alloy ribbon that has been peeled off, and a polishing brush roll which includes a roll axis member and a polishing brush that is equipped with plural brush bristles and is placed around the roll axis member, satisfies the following condition (1) and condition (2), is provided between the peeling means and the molten metal nozzle in the periphery of the chill roll, and is used for polishing by bringing the polishing brush into contact with the peripheral surface of the chill roll while rotating axially in the reverse direction to the chill roll.

Condition (1): Free length of brush bristles is more than 30 mm but 50 mm or less.

Condition (2): Density of brush bristles at the brush bristle tip is more than 0.30 bristles/$mm^2$ but 0.60 bristles/$mm^2$ or less.

Advantageous Effects of Invention

According to the present disclosure, an Fe-based amorphous alloy ribbon manufacturing method, with which a wound body in which the occurrence of unwinding collapse is suppressed can be obtained, and a high space factor is achieved from the early stage of production, may be provided.

BRIEF DESCRIPTION OF DRAWINGS

FIG. 1 is a conceptual cross-sectional view schematically showing an example of an Fe-based amorphous alloy ribbon manufacturing device based on a single-roll method, the manufacturing device being suitable for an embodiment of the present disclosure.

DESCRIPTION OF EMBODIMENTS

Hereinafter, embodiments of the present disclosure will be described.

In this specification, a numeral range described by using the term "to" means a range including numeral values described in front of and behind "to" as the lower limit value and the upper limit value.

Further, in this specification, an Fe-based amorphous alloy ribbon refers to a ribbon (thin strip) made from only an Fe-based amorphous alloy.

Furthermore, in this specification, an Fe-based amorphous alloy refers to an amorphous alloy in which the content (atom %) of Fe (iron) is the largest, among the contents of metal elements incorporated therein.

[Fe-Based Amorphous Alloy Ribbon Manufacturing Method (and Manufacturing Device)]

The Fe-based amorphous alloy ribbon manufacturing method according to the embodiment of the present disclosure is a manufacturing method for obtaining a wound body of an Fe-based amorphous alloy ribbon, using an Fe-based amorphous alloy ribbon manufacturing device.

The Fe-based amorphous alloy ribbon manufacturing device is equipped with a chill roll, in which a coated film of a molten alloy that is a source material for the Fe-based amorphous alloy ribbon is formed on the peripheral surface and the coated film is cooled on the peripheral surface to form an Fe-based amorphous alloy ribbon; a molten metal nozzle that discharges the molten alloy toward the peripheral surface of the chill roll; a peeling means that peels off the Fe-based amorphous alloy ribbon from the peripheral surface of the chill roll; a wind-up roll for winding the Fe-based amorphous alloy ribbon that has been peeled off; and a polishing brush roll, which includes a roll axis member and a polishing brush that is equipped with plural brush bristles and is placed around the roll axis member, satisfies the following condition (1) and condition (2), is provided between the peeling means and the molten metal nozzle in the periphery of the chill roll, and is used for polishing by bringing the polishing brush into contact with the peripheral surface of the chill roll while rotating axially in the reverse direction to the chill roll.

The method includes forming a coated film of the molten alloy on the peripheral surface of the chill roll that has been subjected to polishing by using the polishing means, then cooling the coated film on the peripheral surface, and then winding the Fe-based amorphous alloy ribbon, that has been peeled off by the peeling means, on the wind-up roll, to obtain a wound body of an Fe-based amorphous alloy ribbon.

Condition (1): Free length of brush bristles is more than 30 mm but 50 mm or less.

Condition (2): Density of brush bristles at the brush bristle tip is more than 0.30 bristles/$mm^2$ but 0.60 bristles/$mm^2$ or less.

The present inventors have found that, in discharging a molten alloy onto a chill roll and forming an Fe-based amorphous alloy ribbon, by forming an alloy ribbon while polishing the chill roll with a polishing brush roll that satisfies specific conditions and winding the resulting alloy ribbon to obtain a wound body, unwinding collapse (a phenomenon in which a wound body collapses after the start of unwinding of an alloy ribbon), that occurs when unwinding the alloy ribbon from this wound body, is suppressed and a high space factor is achieved from the early stage of production.

The reason why this effect is exhibited is guessed as follows.

In discharging a molten alloy onto a chill roll and forming (casting) an Fe-based amorphous alloy ribbon, in the course of producing a wound body by winding the alloy ribbon formed, there were cases in which the thickness deviation in the width direction ends of the alloy ribbon (the difference between the thickness of one end side and the thickness of the other end side) increases. As a result, in unwinding again the alloy ribbon from a wound body of an alloy ribbon which has been wound on the wind-up roll, there were cases in which the wound body is likely to collapse toward one direction in the width direction (unwinding collapse).

Further, in discharging a molten alloy onto a chill roll and forming (casting) an Fe-based amorphous alloy ribbon, there are cases in which the space factor of the alloy ribbon becomes low from the early stage after the start of winding of the alloy ribbon formed.

Note that, this phenomenon tends to be more remarkable, particularly, in the case of forming (casting) an alloy ribbon having a content of Fe of 81 atom % or more when a total content of Fe, Si, B, C, and impurities is 100 atom %, as the composition of the Fe-based amorphous alloy ribbon.

It is thought that the unwinding collapse occurs, since the wettability between the molten alloy and the material (for example, a Cu alloy or the like) of the peripheral surface of the chill roll is favorable in the casting of an alloy ribbon (particularly, an alloy ribbon to have a content of Fe of 81 atom % or more).

That is, a molten alloy discharged through a molten metal nozzle is brought into contact with a chill roll and is rapidly solidified. At the interface thereof, the molten alloy has excellent adhesion. Particularly, an alloy ribbon to have a content of Fe of 81 atom % or more is rapidly quenched more easily and a stable amorphous state is more likely to be obtained, as compared with a conventional alloy ribbon having a content of Fe of about 80 atom %.

Meanwhile, the alloy ribbon is continuously peeled off from the chill roll. Since adhesion of the interface between the alloy ribbon that has been rapidly quenched and the chill roll (for example, a Cu alloy) is large as described above, in peeling off the alloy ribbon from the chill roll, there were cases in which a very small portion (a Cu alloy or the like) of the surface of the chill roll is torn off by the alloy ribbon. It turns out that this phenomenon is remarkably exhibited especially at a width direction end of the alloy ribbon. Therefore, at a part (particularly, at a width direction end) where a portion of the surface of the chill has been torn off by the alloy ribbon, a recessed part is generated on the surface of the chill roll, and the gap (distance) between the molten metal nozzle and the chill roll becomes greater, so that a phenomenon occurs, in which a thickness of a width direction end of the alloy ribbon becomes greater only at one end side. As a result, it is understood that, in the wound body obtained by winding the alloy ribbon, the thickness deviation in the width direction ends (the difference between the thickness of one end side and the thickness of the other end side) increases, and unwinding collapse occurs when unwinding again the alloy ribbon from this wound body.

Further, in a case in which tearing off of a surface of a chill roll by an alloy ribbon occurs irregularly in the two width direction ends of the alloy ribbon, WC becomes larger with the progress of casting time (namely, in the course of winding of an alloy ribbon) and, as a result, unwinding collapse occurs as described above.

On the other hand, in a case in which tearing off of a surface of a chill roll by an alloy ribbon occurs relatively almost equally in the two ends, WC and the space factor are not likely to change before and after the winding of the alloy ribbon; however, the space factor becomes low from the early stage of production. It is thought that this phenomenon occurs, since the thickness of the center part of the alloy ribbon formed is smaller, as compared with the thicknesses of the two width direction ends of the alloy ribbon.

Whereas, in the embodiment of the present disclosure, an Fe-based amorphous alloy ribbon manufacturing device equipped with a polishing brush roll, which is provided between the peeling means and the molten metal nozzle in the periphery of the chill roll and is used for polishing by bringing the polishing brush into contact with the peripheral surface of the chill roll, is used; and this polishing brush roll has a roll axis member and a polishing brush, which is equipped with plural brush bristles and is placed around the roll axis member, and satisfies the free length of the brush bristles shown in condition (1) above and the density of the brush bristles shown in condition (2) above.

It is thought that, by forming an alloy ribbon while polishing the chill roll under these conditions and winding the resulting alloy ribbon, the entire width direction region of the surface of the chill roll, including a part where a portion of the surface is to be torn off by the alloy ribbon to be peeled, is polished continuously, so that the entire width direction region can be flattened continuously, before a recessed part generated at the width direction end becomes apparent. It is guessed that, according to the above, generation of a recessed part on the surface of the chill roll is suppressed, and occurrence of a phenomenon in which a thickness of a width direction end of the alloy ribbon becomes greater only at one end side (the thickness deviation in the width direction ends of the alloy ribbon becomes larger) is suppressed and, as a result, unwinding collapse of an alloy ribbon toward one end side in the width direction, which occurs when unwinding the alloy ribbon from a wound body, is suppressed.

Further, in the embodiment of the present disclosure, formation of an Fe-based amorphous alloy ribbon is performed while polishing the chill roll with a polishing brush roll that satisfies the free length of brush bristles shown in condition (1) above and the density of brush bristles shown in condition (2) above.

It is thought that, according to this method, the entire width direction region of the surface of the chill roll is polished continuously, so that the entire width direction region can be flattened continuously. It is guessed that, by the above, also in the alloy ribbon to be formed, the difference between the thicknesses of the two width direction ends and the thickness of the center portion is reduced and, as a result, lowering of the space factor LF is suppressed and a high space factor is achieved from the early stage of production.

Here, a preferable example of the Fe-based amorphous alloy ribbon manufacturing method according to the embodiment of the present disclosure is explained by referring to the drawing.

As to the Fe-based amorphous alloy ribbon manufacturing method according to the embodiment of the present disclosure, a single-roll method is preferable.

FIG. 1 is a conceptual cross-sectional view schematically showing an example of an Fe-based amorphous alloy ribbon manufacturing device based on a single-roll method, the manufacturing device being suitable for the embodiment of the present disclosure.

As shown in FIG. 1, an alloy ribbon manufacturing device 100, which is an Fe-based amorphous alloy ribbon manufacturing device, is provided with a crucible 20 provided with a molten metal nozzle 10, and a chill roll 30 whose peripheral surface faces a tip of the molten metal nozzle 10.

FIG. 1 shows a cross section of the alloy ribbon manufacturing device 100 sectioned by a plane perpendicular to the axial direction of the chill roll 30 and to the width direction of an alloy ribbon 22C. Here, the alloy ribbon 22C is an example of the Fe-based amorphous alloy ribbon according to the embodiment of the present disclosure. Further, the axial direction of the chill roll 30 and the width direction of the alloy ribbon 22C are identical.

The crucible 20 has an internal space that can accommodate a molten alloy 22A, which is a source material for an alloy ribbon 22C, and this internal space is communicated with a molten metal flow channel in a molten metal nozzle 10. As a result, a molten alloy 22A accommodated in the crucible 20 can be discharged through the molten metal nozzle 10 to the chill roll 30 (in FIG. 1, the discharge direction and the flow direction of the molten alloy 22A is represented by the arrow Q). A crucible 20 and a molten metal nozzle 10 may be configured as an integrated body or as separate bodies.

At least partly around a crucible 20, a high-frequency coil 40 is placed as a heating means. By using this heating means, a crucible 20 in a state accommodating a mother alloy of an alloy ribbon can be heated to form a molten alloy 22A in the crucible 20, or a molten alloy 22A supplied from the outside to the crucible 20 can be kept in a liquid state.

Molten Metal Nozzle

A molten metal nozzle 10 has an opening (a discharge port) for discharging a molten alloy.

It is preferable that the opening is a rectangular (slit shape) opening.

The length of a long side of a rectangular opening corresponds to the width of an amorphous alloy ribbon to be produced. The length of a long side of a rectangular opening is preferably from 100 mm to 500 mm, more preferably from 100 mm to 400 mm, still more preferably from 100 mm to 300 mm, and particularly preferably from 100 mm to 250 mm The distance (the closest distance) between the tip of the molten metal nozzle 10 and the peripheral surface of the chill roll 30 is so small that, when the molten alloy 22A is discharged through the molten metal nozzle 10, a puddle 22B (a molten metal puddle) is formed.

The discharge pressure of the molten alloy is preferably from 10 kPa to 25 kPa, and more preferably from 15 kPa to 20 kPa.

Further, the distance between the molten metal nozzle tip and the peripheral surface of the chill roll is preferably from 0.2 mm to 0.4 mm Chill Roll The chill roll 30 rotates axially in the direction of the rotational direction P.

A cooling medium such as water is circulated inside the chill roll 30, with which the coated film of a molten alloy formed on the peripheral surface of the chill roll 30 can be cooled. By cooling the coated film of the molten alloy, an alloy ribbon 22C (an Fe-based amorphous alloy ribbon) is formed.

Examples of the material of the chill roll 30 include Cu and Cu alloys (for example, a Cu—Be alloy, a Cu—Cr alloy, a Cu—Zr alloy, a Cu—Cr—Zr alloy, a Cu—Ni alloy, a Cu—Ni—Si alloy, a Cu—Ni—Si—Cr alloy, a Cu—Zn alloy, a Cu—Sn alloy, a Cu—Ti alloy, and the like). From the viewpoints of having a high thermal conductivity and a high durability, a Cu alloy is preferable, and a Cu—Be alloy, a Cu—Cr—Zr alloy, a Cu—Ni alloy, a Cu—Ni—Si alloy, or a Cu—Ni—Si—Cr alloy can be selected.

Although there is no particular limitation as to the surface roughness of the peripheral surface of the chill roll 30, the arithmetic average roughness (Ra) of the peripheral surface of the chill roll 30 is preferably from 0.1 μm to 0.5 μm, and more preferably from 0.1 μm to 0.3 μm. When the arithmetic average roughness Ra of the peripheral surface of the chill roll 30 is 0.5 μm or less, the space factor in the production of a transformer using the alloy ribbon is further enhanced. When the arithmetic average roughness Ra of the peripheral surface of the chill roll 30 is 0.1 μm or more, in processing the peripheral surface of the chill roll 30, it becomes easier to perform uniform processing in the width direction of the alloy ribbon (the chill roll rotation axial direction).

Concerning the above arithmetic average roughness Ra of the peripheral surface of the chill roll 30, since the peripheral surface of the chill roll is polished by using the polishing brush roll described below in the production of an alloy ribbon, substantially the same Ra can be maintained even after the production of the alloy ribbon.

The arithmetic average roughness Ra refers to a surface roughness measured according to JIS B 0601:2013.

From the viewpoint of cooling power, the diameter of the chill roll 30 is preferably from 200 mm to 1000 mm, and more preferably from 300 mm to 800 mm.

Further, the rotation speed of the chill roll 30 may be in a range ordinary set for a single-roll method. A circumferential speed of from 10 m/s to 40 m/s is preferable, and a circumferential speed of from 20 m/s to 30 m/s is more preferable.

Peeling Means

The alloy ribbon manufacturing device 100 is further provided with a peeling gas nozzle 50, as a peeling means for peeling off the Fe-based amorphous alloy ribbon from the peripheral surface of the chill roll, at a downstream side of the molten metal nozzle 10 in the rotational direction of the chill roll 30 (hereinafter, also referred to, simply, as "the downstream side").

In this example, by blowing a peeling gas through the peeling gas nozzle 50 in the reverse direction (the direction of a dashed line arrow in FIG. 1) to the rotational direction P of the chill roll 30, peeling of the alloy ribbon 22C from the chill roll 30 is performed. As the peeling gas, for example, a nitrogen gas or a high pressure gas such as compressed air can be used.

Polishing Brush Roll

The alloy ribbon manufacturing device 100 is further provided with a polishing brush roll 60 as a polishing means for polishing the peripheral surface of the chill roll 30, at a downstream side of the peeling gas nozzle 50.

The polishing brush roll 60 includes a roll axis member 61 and a polishing brush 62 placed around the roll axis member 61. The polishing brush 62 is equipped with numerous brush bristles.

By axially rotating the polishing brush roll 60 in the rotational direction R, the peripheral surface of the chill roll 30 is polished by using the brush bristles of the polishing brush 62. As shown in FIG. 1, the rotational direction R of the polishing brush roll is opposite to the rotational direction P of the chill roll (in FIG. 1, the rotational direction R is counterclockwise, and the rotational direction P is clockwise). Since the rotational direction of a polishing brush roll is opposite to the rotational direction of a chill roll, a specific point in the peripheral surface of the chill roll and a specific brush bristle of the polishing brush roll move toward the same direction at the contact portion of the chill roll and the polishing brush roll.

—Conditions of Polishing Brush—

The free length of the brush bristles (the length of a part of brush bristles, where the brush bristles are not fixed to the roll axis member) is more than 30 mm but 50 mm or less, as shown in condition (1) above. The free length is preferably more than 30 mm but 40 mm or less, and more preferably more than 30 mm but 35 mm or less.

When the free length of the brush bristles is more than 30 mm, the occurrence of partial deep scratches with respect to the chill roll is suppressed, and the frequency of occurrence of a crack in the alloy ribbon is reduced.

When the free length of the brush bristles is 50 mm or less, a phenomenon in which a thickness of a width direction end of the alloy ribbon becomes larger only at one end side is suppressed, and unwinding collapse toward one end side in the width direction of the alloy ribbon, which occurs at the time of unwinding the alloy ribbon from the wound body, is suppressed. Further, lowering of the space factor LF in the alloy ribbon is also suppressed.

The density of the brush bristles at the brush bristle tip (the number of bristles per unit area at the brush bristle tip) is more than 0.30 bristles/mm$^2$ but 0.60 bristles/mm$^2$ or less, as shown in condition (2) above. The density of the brush bristles at the brush bristle tip is preferably from 0.35 bristles/mm$^2$ to 0.50 bristles/mm$^2$, and more preferably from 0.40 bristles/mm$^2$ to 0.45 bristles/mm$^2$.

When the density of the brush bristles exceeds 0.30 bristles/mm$^2$, a phenomenon in which a thickness of a width direction end of the alloy ribbon becomes larger only at one end side is suppressed, and unwinding collapse toward one end side in the width direction of the alloy ribbon, which occurs at the time of unwinding the alloy ribbon from the wound body, is suppressed. Further, lowering of the space factor LF in the alloy ribbon is also suppressed.

When the density of the brush bristles is 0.60 bristles/mm$^2$ or less, melting caused by the frictional heat with respect to the peripheral surface of the chill roll can be suppressed.

The cross sectional shape of the brush bristle is not particularly limited, and examples include a round shape (including oval and a completely round shape) and polygon (preferably, square).

The brush bristle diameter (the diameter of a circle circumscribing the cross section of a brush bristle) is preferably from 0.5 mm to 1.5 mm, and more preferably from 0.6 mm to 1.0 mm.

The diameter of the polishing brush roll may be, for example, from 100 mm to 300 mm, and is preferably from 130 mm to 250 mm.

The length of the axial direction of the polishing brush roll is set as appropriate in accordance with the width of the alloy ribbon to be produced.

—Material of Polishing Brush—

It is preferable that the brush bristle included in the polishing brush contains a resin.

When the brush bristle contains a resin, deep polishing scratches are less likely to occur on the peripheral surface of the chill roll.

The resin is preferably a nylon resin, such as Nylon 6, Nylon 612, or Nylon 66.

Further, the content of the resin in the brush bristle (the content of the resin with respect to the total amount of brush bristle; hereinafter the same applies.) is preferably 50% by mass or more, and more preferably 60% by mass or more. When the content of the resin in the brush bristle is 50% by mass or more, a phenomenon in which deep polishing scratches occur on the peripheral surface of the chill roll is further suppressed.

The upper limit of the content of the resin in the brush bristle may be, for example, 80% by mass or less, or may be 70% by mass or less.

In the brush bristle, it is preferable that inorganic polishing powder is dispersed in the resin.

When inorganic polishing powder is dispersed in the brush bristle, the polishing power with respect to the peripheral surface of the chill roll is further improved.

Examples of the inorganic polishing powder include alumina and silicon carbide.

The particle size of the inorganic polishing powder is preferably from 45 μm to 90 μm, and more preferably from 50 μm to 80 μm.

Here, "the particle size of the inorganic polishing powder" represents the size of a mesh opening of a sieve, through which the particles of the inorganic polishing powder can pass. For instance, "the particle size of the inorganic polishing powder is from 45 μm to 90 μm" represents that the inorganic polishing powder passes through a mesh having an opening of 90 μm but does not pass through a mesh having an opening of 45 μm.

The content of the inorganic polishing powder in the brush bristle is preferably from 20% by mass to 40% by mass, and more preferably from 25% by mass to 35% by mass, with respect to the total amount of brush bristle.

When the content of the inorganic polishing powder in the brush bristle is 40% by mass or less, incorporation of the polishing powder into a molten alloy is further suppressed, and defects in the alloy ribbon caused by the polishing powder are suppressed.

—Conditions for Polishing Peripheral Surface of Chill Roll Using Polishing Brush Roll—

The push-in amount of the polishing brush (brush bristle) with respect to the peripheral surface of the chill roll is adjusted as appropriate. The push-in amount can be set to be, for example, from 2 mm to 10 mm.

Here, the push-in amount refers to the distance the brush bristle tip is pushed in toward the chill roll side, the distance the brush bristle tip contacts the peripheral surface of the chill roll being taken as 0 mm.

The relative speed of the polishing brush to the rotation speed of the chill roll, that is, the difference between the rotation speed of the polishing brush and the rotation speed of the chill roll is preferably from +10 m/s to +20 m/s.

When the relative speed is +10 m/s or more, the polishing power with respect to the peripheral surface of the chill roll is further improved.

The relative speed being +20 m/s or less is advantageous in terms of reduction of frictional heat at the time of polishing.

The relative speed is more preferably from +12 m/s to +17 m/s, and still more preferably from +13 m/s to +18 m/s.

In this connection, since the rotational direction of the polishing brush roll is opposite to the rotational direction of the chill roll (the mode shown in FIG. 1), the relative speed of the polishing brush to the rotation speed of the chill roll means the value of difference determined by subtracting the rotation speed (absolute value) of the chill roll from the rotation speed (absolute value) of the polishing brush roll.

Further, the rotation speed of the chill roll means the speed in the rotational direction in the peripheral surface of the chill roll, and the rotation speed of the polishing brush means the speed in the rotational direction in the brush bristle tip in the polishing brush.

Wind-Up Roll

The alloy ribbon manufacturing device 100 is provided with a wind-up roll (not shown in the FIGURE) for winding the alloy ribbon 22C that has been peeled off from the chill roll 30.

The alloy ribbon manufacturing device 100 may be provided with other element (for example, a gas nozzle for blowing a $CO_2$ gas, an $N_2$ gas, or the like to the puddle 22B of a molten alloy or its vicinity, or the like) in addition to the elements described above.

The basic configuration of the alloy ribbon manufacturing device 100 may be similar to a configuration of an amorphous alloy ribbon manufacturing device based on a conventional single-roll method (see, for example, International Publication WO 2012/102379, Japanese Patent No. 3494371, Japanese Patent No. 3594123, Japanese Patent No. 4244123, Japanese Patent No. 4529106, or the like).

Manufacturing Method

Next, an example of a manufacturing method of the alloy ribbon 22C using the alloy ribbon manufacturing device 100 will be described.

First, a molten alloy 22A as a source material for the alloy ribbon 22C is prepared in the crucible 20. The temperature of the molten alloy 22A is set as appropriate considering the composition of the alloy, and is, for example, from 1210° C. to 1410° C. and preferably from 1260° C. to 1360° C.

Next, the molten alloy is discharged through the molten metal nozzle 10 onto the peripheral surface of the chill roll 30, which rotates axially in the rotational direction P, and while forming a puddle 22B, a coated film of the molten alloy is formed. The coated film thus formed is cooled on the peripheral surface of the chill roll 30, to form an alloy ribbon 22C on the peripheral surface. Then, the alloy ribbon 22C formed on the peripheral surface of the chill roll 30 is peeled off from the peripheral surface of the chill roll 30 by blowing a peeling gas through the peeling gas nozzle 50 and is wound on a wind-up roll (not shown in the FIGURE) in a form of a roll for recovery.

Meanwhile, after the alloy ribbon 22C has been peeled off, the peripheral surface of the chill roll 30 is polished by using the polishing brush 62 of the polishing brush roll 60, which rotates axially in the rotational direction R. The molten alloy is discharged again to the peripheral surface of the chill roll 30 that has been subjected to polishing.

The operations described above are carried out repeatedly and thus, a long alloy ribbon 22C is produced (casted) continuously.

By the manufacturing method according to the example described above, an alloy ribbon 22C, which is an example of the Fe-based amorphous alloy ribbon according to the embodiment of the present disclosure, is produced.

Here, in the manufacturing method according to the embodiment of the present disclosure, an Fe-based amorphous alloy ribbon is produced (casted) continuously. The term "continuously" as used herein means that the molten alloy 22A is discharged continuously onto the peripheral surface of the chill roll 30 through the molten metal nozzle 10. Note that, when production (casting) of an Fe-based amorphous alloy ribbon is started, the amount of the molten alloy 22A in the crucible 20 decreases according to the discharge through the molten metal nozzle. However, by supplying intermittently or continuously a new molten alloy 22 A in the crucible 20 before depletion, the molten alloy 22A can be discharged continuously through the molten metal nozzle 10, whereby production (casting) of an Fe-based amorphous alloy ribbon can be performed continuously.

Accordingly, also in a case in which an alloy ribbon is peeled off from the chill roll 30 and then wound on plural different wind-up rolls to obtain plural wound bodies, if formation of the alloy ribbon is conducted by continuously discharging a molten alloy onto the peripheral of the chill roll 30, the alloy ribbon is an alloy ribbon that is produced "continuously".

Note that, according to the manufacturing method according to the embodiment of the present disclosure, in continuously producing (casting) an Fe-based amorphous alloy ribbon, the production (casting) can be conducted continuously on the following conditions. Namely, for example, the casting time is from 60 minutes to 300 minutes, and the casting speed (that is, the circumferential speed of the chill roll 30) is from 20 m/s to 30 m/s.

Size and Physical Properties of Alloy Ribbon

—Size—

The alloy ribbon obtained by the manufacturing method according to the embodiment of the present disclosure preferably has an average thickness T of from 10 μm to 30 μm.

When the thickness T is 10 μm or more, the mechanical strength of the alloy ribbon is ensured, and breakage of alloy ribbon is suppressed. Thus, it becomes easier to perform continuous casting of an alloy ribbon. The thickness T of the alloy ribbon is more preferably 15 μm or more.

When the thickness T is 30 μm or less, a stable amorphous state is obtained in the alloy ribbon. The thickness T of the alloy ribbon is more preferably 28 μm or less.

Here, the average thickness T (m) is obtained by cutting out 1 m of the alloy ribbon in the longitudinal direction, measuring the mass M (kg), and performing calculation according to the following equation from the width W (m) of the alloy ribbon and the specific gravity p (density) ($kg/m^3$) of the alloy.

$$T=M/(W\times\rho)(\mathrm{m})$$

The width (the length of the width direction) of the alloy ribbon is preferably from 100 mm to 500 mm.

When the width of the alloy ribbon is 100 mm or more, a practical transformer having a large capacity can be obtained. When the width of the alloy ribbon is 500 mm or less, the productivity (suitability for production) of the alloy ribbon is excellent.

From the viewpoint of the productivity (suitability for production) of the alloy ribbon, the width of the alloy ribbon is more preferably 400 mm or less, still more preferably 300 mm or less, and particularly preferably 250 mm or less.

—Space Factor—

In the alloy ribbon that is produced (casted) continuously according to the manufacturing method according to the embodiment of the present disclosure, the space factor $LF_{[S]}$ in the early stage of production is preferably from 87% to 94%, more preferably from 88% to 94%, and still more preferably from 89% to 94%.

When the space factor $LF_{[S]}$ in the early stage of production is 87% or more, in an iron core which is produced by disposing the alloy ribbons one on another in layers, a great amount of magnetic flax per unit laminate thickness is obtained. Therefore, miniaturization of the apparent volume of an iron core becomes possible.

Meanwhile, in theory, when the alloy ribbons are disposed one on another in layers with no space therebetween, a space factor of 100% is achieved; however, it is thought that the upper limit is 94%, since in the production (casting) of an alloy ribbon, in principle, variation in the thickness of the width direction occurs irreversibly, and the like.

Further, in the alloy ribbon that is produced (casted) continuously according to the manufacturing method according to the embodiment of the present disclosure, a rate of change $(LF_{[E]}-LF_{[S]})/LF_{[S]}\times100)$ in a space factor $LF_{[E]}$ in the end stage of production (just before finishing the production) from a space factor $LF_{[S]}$ in the early stage of production is preferably ±2% or less, and more preferably ±1% or less.

When the rate of change in a space factor $LF_{[E]}$ in the end stage of production from a space factor $LF_{[S]}$ in the early stage of production is ±2% or less, a wound body of an alloy ribbon, in which unevenness in quality is suppressed, can be obtained. Further, in an iron core which is produced by disposing, one on another in layers, the alloy ribbons that are casted in the end stage of production (just before finishing the production), a great amount of magnetic flax per unit laminate thickness is obtained, and therefore, miniaturization of the apparent volume of an iron core becomes possible.

Note that, the space factor LF refers to a space factor (%) measured in accordance with ASTM A900/A900M-01 (2006).

Here, measurement of a space factor $LF_{[S]}$ in the "early stage of production" of an alloy ribbon that is produced (casted) continuously is performed as follows. First, 20 sheets of samples are cut out from a range of an alloy ribbon, the range being a range produced within a time period of from 5 minutes to 7 minutes after the start of production (the start of discharge of a molten alloy) by continuously cutting every 20 mm toward the longitudinal direction (the alloy ribbon winding direction). Note that, in the case of a wound body in which the range produced within a time period of from 5 minutes to 7 minutes after the start of production is not clear, a range of the alloy ribbon, the range being a range of from 3000 m to 4200 m from the end on the winding start side in the wound body is used. Accordingly, 20 sheets of the "early stage alloy ribbon samples" each having a strip shape, in which the width direction in the alloy ribbon corresponds to the long side and the longitudinal direction in the alloy ribbon corresponds to the short side, are obtained. With regard to these 20 sheets of the early stage alloy ribbon samples, a space factor that is measured according to the method described above is taken as the space factor $LF_{[S]}$ in the "early stage of production".

Further, measurement of a space factor $LF_{[S]}$ in the "end stage of production (just before finishing the production)" of an alloy ribbon that is produced (casted) continuously is performed as follows. First, 20 sheets of samples are cut out from a range of an alloy ribbon, the range being a range of 1 m from the last end formed at the time of finishing the production (the end on the winding finish side in the wound body), by continuously cutting every 20 mm toward the longitudinal direction (the alloy ribbon winding direction). Accordingly, 20 sheets of the "end stage alloy ribbon samples" each having a strip shape, in which the width direction in the alloy ribbon corresponds to the long side and the longitudinal direction in the alloy ribbon corresponds to the short side, are obtained. With regard to these 20 sheets of the end stage alloy ribbon samples, a space factor that is measured according to the method described above is taken as the space factor $LF_{[E]}$ in the "end stage of production (just before finishing the production)".

—WC—

In the alloy ribbon that is produced (casted) continuously according to the manufacturing method according to the embodiment of the present disclosure, $WC_{[S]}$ in a layered body prepared by disposing, one on another in layers, 20 sheets of the alloy ribbon in the early stage of production is preferably from 5 μm/20 sheets to 40 μm/20 sheets, more preferably from 5 μm/20 sheets to 30 μm/20 sheets, and still more preferably from 5 μm/20 sheets to 20 μm/20 sheets.

When $WC_{[S]}$ in the early stage of production is 5 μm/20 sheets or more, the occurrence of positional deviation in the width direction (shift toward the width direction) between alloy ribbons that are adjacent with each other in the lamination direction of the alloy ribbons, just after being wound on a wind-up roll, is suppressed.

When $WC_{[S]}$ in the early stage of production is 40 μm/20 sheets or less, unwinding collapse toward one end side in the width direction of the alloy ribbon, which occurs when unwinding the alloy ribbon from a wound body, and lowering of the space factor are suppressed more easily.

Further, in the alloy ribbon that is produced (casted) continuously according to the manufacturing method according to the embodiment of the present disclosure, a rate of change $((WC_{[E]}-WC_{[S]})/WC_{[S]}\times 100)$ in $WC_{[E]}$ in a layered body prepared by disposing, one on another in layers, 20 sheets of the alloy ribbon in the end stage of production (just before finishing the production), from $WC_{[S]}$ in the early stage of production is preferably from −12% to +80%, more preferably from −12% to +60%, and still more preferably from −12% to +40%.

When the rate of change in $WC_{[E]}$ in the end stage of production from $WC_{[S]}$ in the early stage of production is +80% or less, a wound body of an alloy ribbon, in which unevenness in quality is suppressed, can be obtained. Further, unwinding collapse toward one end side in the width direction, which occurs when unwinding again the alloy ribbon from a wound body that is obtained using an alloy ribbon that has been casted in the end stage of production (just before finishing the production), and lowering of the space factor are suppressed more easily.

When the rate of change in $WC_{[E]}$ in the end stage of production from $WC_{[S]}$ in the early stage of production is −12% or more, a wound body of an alloy ribbon, in which unevenness in quality is suppressed, can be obtained. Further, the occurrence of positional deviation (shift toward the width direction) in the width direction between alloy ribbons that are adjacent with each other in the lamination direction of the alloy ribbons, which have been casted in the end stage of production ((just before finishing the production), just after being wound on a wind-up roll, is suppressed.

Note that, the measurement of WC (Wedge Coefficient) is performed as follows. Alloy ribbons each having a strip shape, in which the width in the alloy ribbon is the long side and the short side length is 20 mm, are obtained by cutting an alloy ribbon every 20 mm toward the longitudinal direction to cut out 20 sheets. The above 20 sheets of strip-shaped alloy ribbons are disposed one on another in layers to prepare a layered body having 20 layers. With regard to each of one end (IB) and the other end (OB) in the long side direction in this layered body (width direction), thicknesses of three points in a range of from 0 mm to 16 mm from the end, a range of from 10 mm to 26 mm from the end, and a range of from 20 mm to 36 mm from the end are measured by using a micrometer employing an anvil having a diameter of 16 mm. The greater one of the difference between the maximum value ($IB_{max}$) of one end side and the minimum value ($OB_{min}$) of the other end side and the difference between the minimum value ($IB_{min}$) of one end side and the maximum value ($OB_{max}$) of the other end side is taken as WC (Wedge Coefficient).

WC measured with regard to the "early stage alloy ribbon samples" described above is taken as "$WC_{[S]}$", and WC measured with regard to the "end stage alloy ribbon samples" described above is taken as "$WC_{[E]}$".

Composition of Alloy Ribbon

The composition of the Fe-based amorphous alloy ribbon in the embodiment of the present disclosure is not particularly limited as far as the content (atom %) of Fe (iron) is the largest, among the contents of metal elements incorporated therein.

The Fe-based amorphous alloy contains at least Fe (iron), but it is preferable to further contain Si (silicon) and B (boron). The Fe-based amorphous alloy may further contain C (carbon), which is an element incorporated in the source materials for a molten alloy, such as pure iron.

The Fe-based amorphous alloy is preferably an Fe-based amorphous alloy in which the content of Si is from 1.8 atom % to 4.2 atom %, the content of B is from 13.8 atom % to 16.2 atom %, and the content of C is from 0.05 atom % to 0.4 atom % when the total content of Fe, Si, B, C and impurities is 100 atom %, with the remainder consisting of Fe and impurities. The content of Fe in the Fe-based amorphous alloy is preferably from 80 atom % to 83 atom %.

Further, an Fe-based amorphous alloy is preferable, in which the content of Si is from 2 atom % to 4 atom %, the content of B is from 14 atom % to 16 atom %, and the content of C is from 0.2 atom % to 0.3 atom % when the total content of Fe, Si, B, C and impurities is 100 atom %, with the remainder consisting of Fe and impurities. The content of Fe in the Fe-based amorphous alloy is preferably from 81 atom % to 83 atom %.

When the content of Fe in the Fe-based amorphous alloy is 80 atom % or more, a saturation flux density of the alloy ribbon becomes higher, and thus an increase in size or an increase in weight of a magnetic core to be produced by using the alloy ribbon is further suppressed.

When the content of Fe is 83 atom % or less, a decrease in Curie point of the alloy and a decrease in the crystallization temperature are further suppressed, and thus the stability of magnetic properties of the magnetic core is further enhanced.

Furthermore, when the content of C (carbon) in the Fe-based amorphous alloy is 0.4 atom % or less, embrittlement of the alloy ribbon is further suppressed.

When the content of C (carbon) in the Fe-based amorphous alloy is 0.2 atom % or more, productivity of the molten alloy and productivity of the alloy ribbon are excellent.

EXAMPLES

Hereinafter, Examples of the present disclosure are described; however, the present disclosure is by no means limited to the following Examples.

Examples 1 to 5, Comparative Examples 1 to 10

<Production of Fe-Based Amorphous Alloy Ribbon>

An alloy ribbon manufacturing device having a configuration similar to that of the alloy ribbon manufacturing device 100 shown in FIG. 1 was prepared.

As the chill roll, a chill roll having a diameter of 400 mm, in which the material of the peripheral surface is a Cu—Ni alloy and an arithmetic average roughness Ra of the peripheral surface is 0.3 μm, was used.

First, a molten alloy consisting of Fe, Si, B, C, and impurities (hereinafter also referred to as an "Fe—Si—B—C-based molten alloy") was prepared in a crucible. Specifically, pure iron, ferrosilicon, and ferroboron were mixed and melted, to prepare a molten alloy having a composition in which the contents of Fe, impurities, Si, B, and C are as described in Table 1 below when the total content of Fe, impurities, Si, B, and C is 100 atom %. These numerical values of atom % are values obtained by extracting a portion of the alloy from the molten metal and converting the amounts of Si, B, and C determined by performing measurement according to ICP (inductively coupled plasma) optical emission spectrophotometry or the like to atom %, with the remainder consisting of Fe and impurities.

Next, the Fe—Si—B—C-based molten alloy was discharged through an opening of a molten metal nozzle, the opening having a rectangular shape (slit shape) with a long side length of 213.4 mm and a short side length of 0.6 mm, onto the peripheral surface of the rotating chill roll for rapid solidification, to produce (cast) an amorphous alloy ribbon having a ribbon width of 213.4 mm and an average thickness of 25 μm. The casting time was 120 minutes and the alloy ribbon was casted continuously without causing any breakage of the alloy ribbon (however, in Comparative Example 6, breakage occurred in the alloy ribbon during winding).

The above casting was performed while polishing the peripheral surface of the chill roll by using a polishing brush (brush bristles) of a polishing brush roll. This polishing was performed such that the polishing brush of the polishing brush roll was brought into contact with the peripheral surface of the chill roll at the entire width direction region. The molten alloy was discharged onto the peripheral surface of the chill roll that had been polished (see FIG. 1).

Detailed conditions for the above casting are shown below.

—Casting Conditions—

Temperature of molten alloy: 1320° C.

Circumferential speed of chill roll: 23 m/s

Discharge pressure of molten alloy: adjusted within the range of from 18 kPa to 22 kPa Distance (gap) between molten metal nozzle tip and peripheral surface of chill roll: adjusted within the range of from 0.1 mm to 0.4 mm Casting time: 120 minutes —Polishing Brush Roll—

As the polishing brush roll, a polishing brush roll having brush bristles that include Nylon 612 as the resin and silicon carbide as the inorganic polishing powder was used.

The polishing brush roll and the polishing conditions are as follows.

Cross sectional shape of brush bristle: a round shape

Diameter of polishing brush roll: differs depending on the free length of the brush bristle (in a case in which the free length of brush bristles is 42 mm, the diameter is 130 mm)

Length of axial direction of polishing brush roll: 300 mm

Brush bristle diameter: (described in Table 1)

Free length of brush bristles: (described in Table 1)

Density of brush bristles at the brush bristle tip: (described in Table 1)

Particle size of polishing powder in brush bristle (polishing brush): (described in Table 1)

Content of polishing powder in brush bristle (polishing brush): (described in Table 1)

—Polishing Conditions—

Relative speed of polishing brush to chill roll: adjusted within the range of from 10 m/s to 18 m/s Relationship between rotational direction of polishing brush roll and rotational direction of chill roll: opposite direction (at the contact portion, a specific point in the peripheral surface of the chill roll and a specific brush bristle of the polishing brush roll move toward the same direction)

Push-in amount of polishing brush (brush bristle) with respect to peripheral surface of chill roll: 5 mm <Measurement of Space Factor (Evaluation of Space Factor)>

Space factor LF refers to the proportion of the cross-sectional area of alloy ribbons in the cross-sectional area of a layered body prepared by disposing the alloy ribbons one on another in layers. A value closer to 100% indicates a higher proportion of alloy ribbons in the layered body.

Each of the space factor $LF_{[S]}$ in the early stage of production in the 120 minutes alloy ribbon production and the space factor $LF_{[E]}$ in the end stage of production (just before finishing the production) indicates a space factor (%) measured in accordance with ASTM A900/A900M-01 (2006).

The space factor $LF_{[S]}$ was measured by obtaining 20 sheets of the "early stage alloy ribbon samples" described above, and the space factor $LF_{[E]}$ was measured by obtaining 20 sheets of the "end stage alloy ribbon samples" described above.

Further, the rate of change $((LF_{[E]}-LF_{[S]})/LF_{[S]}\times 100)$ in a space factor $LF_{[E]}$ in the end stage of production (just before finishing the production) from a space factor $LF_{[S]}$ in the early stage of production was calculated.

<Measurement of WC>

Measurement of WC is conducted using a micrometer employing an anvil having a diameter of 16 mm By cutting the alloy ribbon every 20 mm toward the longitudinal direction to cut out 20 sheets, alloy ribbons each having a strip shape, in which the width in the alloy ribbon is the long side and the short side length is 20 mm, are obtained. 20 sheets of the strip shaped alloy ribbons are disposed one on another in layers. With regard to each of one end (IB) and the other end (OB) in the width direction in the layered body including 20 sheets, the thicknesses of three points (three points in a range of from 0 mm to 16 mm from the end, a range of from 10 mm to 26 mm from the end, and a range of from 20 mm to 36 mm from the end) are measured. The greater one of the difference between the maximum value ($IB_{max}$) of one end side and the minimum value ($OB_{min}$) of the other end side and the difference between the minimum value ($IB_{min}$) of one end side and the maximum value ($OB_{max}$) of the other end side is taken as "WC (Wedge Coefficient)".

$WC_{[S]}$ in the early stage of production was measured by obtaining 20 sheets of the "early stage alloy ribbon samples" described above, and $WC_{[E]}$ in the end stage of production (just before finishing the production) was measured by obtaining 20 sheets of the "end stage alloy ribbon samples" described above.

Further, the rate of change $((WC_{[E]}-WC_{[S]})/WC_{[S]}\times 100)$ in $WC_{[E]}$ in the end stage of production (just before finishing the production) from $WC_{[S]}$ in the early stage of production was calculated.

Note that, the alloy ribbon formed has an average thickness of 25 μm, a density of 7.33 g/cm$^3$=7330 kg/m$^3$, and a width of 213 mm. When the mass in one wound body is taken as 800 kg, and the length in one wound body is taken as X (m), $$25\times 10^{-6}\ (\mathrm{m})\times 213\times 10^{-3}\ (\mathrm{m})\times X\ (\mathrm{m})\times 7330\ (\mathrm{kg})=800\ (\mathrm{kg})$$

By solving this equation, X is about 20496 m. That is, the length of the alloy ribbon in one wound body is about 21 km.

Meanwhile, since the speed is 23 m/s, the length of an alloy ribbon formed in 120 minutes after the start of casting is "23 (m/s)×60 (s)×120 (m)=166 (km)".

When the length of the alloy ribbon in one wound body is taken as 21 km, the alloy ribbon with a length of 166 km, which is formed in 120 minutes, is 8 times longer, corresponding to the length for 8 wound bodies.

<Evaluation of Unwinding Property of Wound Body>

With regard to the wound bodies corresponding to 8 rolls, which had been prepared through the 120 minutes alloy ribbon formation, unwinding of an alloy ribbon from the wound bodies was conducted, and the presence or absence of the occurrence of unwinding collapse (a phenomenon in which a wound body collapses after the start of unwinding of an alloy ribbon) toward one end side in the ribbon width direction was checked. Here, even in a case in which the collapse during unwinding has occurred only in one wound body among the plural wound bodies, the wound bodies are evaluated as "presence of collapse".

In addition, other phenomenon which was observed after the 120 minutes alloy ribbon formation are shown in the following Table 2 and Table 3.

TABLE 1

| | Alloy Composition [atom %] | | | | Ribbon | Polishing Brush | | | | | |
|---|---|---|---|---|---|---|---|---|---|---|---|
| | | | | | | Brush Bristle | | | Polishing Powder | | |
| | Fe & Impurities, | Si | B | C | Width [mm] | Density [Number/mm$^2$] | Free Length [mm] | Diameter [mm] | Particles Diameter [mesh] | Particles Diameter [μm] | Content [%] |
| Example 1 | 81.5 | 3.8 | 14.6 | 0.1 | 213.4 | 0.38 | 42 mm | 0.75 | 240 | 60 | 30% |
| Example 2 | 81.5 | 3.8 | 14.6 | 0.1 | 213.4 | 0.41 | 35 mm | 0.90 | 325 | 45 | 30% |
| Example 3 | 81.8 | 2 | 16 | 0.2 | 213.4 | 0.40 | 42 mm | 0.75 | 240 | 60 | 30% |
| Example 4 | 81.7 | 2 | 16 | 0.3 | 213.4 | 0.55 | 42 mm | 0.75 | 240 | 60 | 30% |
| Example 5 | 81.8 | 2 | 16 | 0.2 | 213.4 | 0.35 | 42 mm | 0.75 | 240 | 60 | 30% |
| Comparative Example 1 | 81.5 | 3.8 | 14.6 | 0.1 | 213.4 | 0.21 | 54 mm | 0.75 | 240 | 60 | 30% |
| Comparative Example 2 | 81.5 | 3.8 | 14.6 | 0.1 | 213.4 | 0.20 | 30 mm | 0.75 | 240 | 60 | 30% |
| Comparative Example 3 | 81.5 | 3.8 | 14.6 | 0.1 | 213.4 | 0.19 | 54 mm | 1.00 | 180 | 90 | 30% |
| Comparative Example 4 | 81.5 | 3.8 | 14.6 | 0.1 | 213.4 | 0.20 | 54 mm | 0.90 | 240 | 60 | 30% |
| Comparative Example 5 | 81.7 | 2 | 16 | 0.3 | 213.4 | 0.20 | 54 mm | 0.75 | 240 | 60 | 30% |
| Comparative Example 6 | 81.7 | 2 | 16 | 0.3 | 213.4 | 0.30 | 54 mm | 0.55 | 320 | 45 | 30% |
| Comparative Example 7 | 81.8 | 2 | 16 | 0.2 | 213.4 | 0.40 | 55 mm | 0.75 | 240 | 60 | 30% |
| Comparative Example 8 | 81.8 | 2 | 16 | 0.2 | 213.4 | 0.40 | 25 mm | 0.75 | 240 | 60 | 30% |
| Comparative Example 9 | 81.8 | 2 | 16 | 0.2 | 213.4 | 0.20 | 42 mm | 0.75 | 240 | 60 | 30% |
| Comparative Example 10 | 81.8 | 2 | 16 | 0.2 | 213.4 | 0.70 | 42 mm | 0.75 | 240 | 60 | 30% |

TABLE 2

| | Early Stage (Winding start side) | | End Stage (120 minutes after) (Winding finish side) | | Rate of Change for (End Stage − Early Stage) | | Evaluation of Unwinding Property Presence or Absence of Occurrence of Unwinding Collapse |
|---|---|---|---|---|---|---|---|
| | Space Factor $LF_{[S]}$ [%] | $WC_{[S]}$ [μm/20 sheets] | Space Factor $LF_{[E]}$ [%] | $WC_{[E]}$ [μm/20 sheets] | $(LF_{[E]} - LF_{[S]})/LF_{[S]} \times 100)$ [%] | $(WC_{[E]} - WC_{[S]})/WC_{[S]} \times 100)$ [%] | |
| Example 1 | 87.8 | 21 | 88.1 | 19 | 0.3 | −9.5 | none |
| Example 2 | 90.4 | 16 | 91.2 | 18 | 0.9 | 12.5 | none |
| Example 3 | 88.3 | 20 | 88.7 | 19 | 0.5 | −5.0 | none |
| Example 4 | 88.1 | 17 | 88.9 | 18 | 0.9 | 5.9 | none |
| Example 5 | 89.1 | 21 | 88.4 | 37 | −0.8 | 76.2 | none |

TABLE 3

| | Early Stage (Winding start side) | | End Stage (120 minutes after) (Winding finish side) | | Rate of Change for (End Stage − Early Stage) | | Evaluation of Unwinding Property Presence or Absence of Occurrence of Unwinding Collapse |
|---|---|---|---|---|---|---|---|
| | Space Factor $LF_{[S]}$ [%] | $WC_{[S]}$ [μm/20 sheets] | Space Factor $LF_{[E]}$ [%] | $WC_{[E]}$ [μm/20 sheets] | $(LF_{[E]} - LF_{[S]})/LF_{[S]} \times 100)$ [%] | $(WC_{[E]} - WC_{[S]})/WC_{[S]} \times 100)$ [%] | |
| Comparative Example 1 | 88.0 | 18 | 86.5 | 47 | −1.7 | 161.1 | presence |
| Comparative Example 2 | 87.3 | 20 | 87.4 | 17 | 0.1 | −15.0 | none |
| Comparative Example 3 | 84.8 | 16 | 84.9 | 15 | 0.1 | −6.3 | none |
| Comparative Example 4 | 85.4 | 17 | 85.3 | 16 | −0.1 | −5.9 | none |
| Comparative Example 5 | 88.6 | 20 | 86.7 | 53 | −2.1 | 165.0 | presence |
| Comparative Example 6 | 91.2 | 24 | — | — | — | — | — |
| Comparative Example 7 | 89.3 | 18 | 86.3 | 52 | −3.4 | 188.9 | presence |
| Comparative Example 8 | 85.2 | 15 | 84.8 | 14 | −0.5 | −6.7 | none |
| Comparative Example 9 | 88.4 | 18 | 86.7 | 43 | −1.9 | 138.9 | presence |
| Comparative Example 10 | 87.8 | 13 | — | — | — | — | — |

Note that, in the test for the evaluation of unwinding property of the wound body, the following phenomenon was observed.

In Comparative Example 2, deep scratches were formed partially during winding, and a crack occurred in the ribbon.

In Comparative Example 6, the ribbon was brittle, and breakage occurred frequently during winding, such that winding could not be conducted.

In Comparative Example 8, deep scratches were formed partial during winding, and a crack occurred in the ribbon.

In Comparative Example 10, the brush bristles of the polishing brush roll were melt, it was impossible to perform polishing, and the ribbon became brittle.

As shown in Table 1 to Table 3, in the alloy ribbons of the Examples of the invention, in which polishing of the chill roll was performed using a polishing brush roll that satisfies the condition (1) and the condition (2), occurrence of collapse during unwinding was suppressed.

Further, regarding the space factor, in Examples 1 to 5, the value ($LF_{[S]}$) in the early stage of production was 87.8% or more, and even in the end stage of production (after 120 minutes, $LF_{[E]}$), the rate of change from the value ($LF_{[S]}$) in the early stage of production was within ±1%.

In contrast, in Comparative Examples 1 and 5, in which the free length of the brush bristles in the polishing brush roll exceeds 50 mm and the density of the brush bristles is 0.30 bristles/mm$^2$ or less, collapse occurred during unwinding of the alloy ribbon.

Further, in Comparative Example 2, in which the free length of the brush bristles in the polishing brush roll is 30 mm or less and the density of the brush bristles is 0.30 bristles/mm$^2$ or less, deep scratches were formed partially, and a crack occurred in the alloy ribbon.

Further, in Comparative Example 6, in which the free length of the brush bristles in the polishing brush roll exceeds 50 mm, the density of the brush bristles is 0.30 bristles/mm$^2$ or less, the brush bristle diameter is smaller than that in Comparative Example 1, and the particle diameter of the polishing powder is smaller than that in Comparative Example 1, the alloy ribbon was brittle, and breakage occurred frequently during winding, such that winding could not be conducted.

Further, in Comparative Example 3, in which the diameter of the brush bristles in the polishing brush roll is greater than that in Comparative Example 1 and the particle diameter of the polishing powder is greater than that in Comparative Example 1, and in Comparative Example 4, in which the diameter of the brush bristles in the polishing brush roll is greater than that in Comparative Example 1, the value of the space factor $LF_{[S]}$ was low from the early stage of production of the alloy ribbon.

Further, in Comparative Example 7, in which the free length of the brush bristles in the polishing brush roll exceeds 50 mm, collapse occurred during unwinding of the alloy ribbon.

Further, in Comparative Example 9, in which the density of the brush bristles in the polishing brush roll is 0.30 bristles/$mm^2$ or less, collapse occurred during unwinding of the alloy ribbon.

Further, in Comparative Example 8, in which the free length of the brush bristles in the polishing brush roll is 30 mm or less, deep scratches were formed partially, and a crack occurred in the alloy ribbon.

Furthermore, in Comparative Example 10, in which the density of the brush bristles in the polishing brush roll exceeds 0.60 bristles/$mm^2$, melting of brush bristles occurred, it was impossible to perform polishing using the polishing brush roll, and the alloy ribbon that was produced was brittle.

As described above, it was confirmed that in the case of forming an alloy ribbon while performing polishing of a chill roll by using a polishing brush roll that satisfies condition (1) and condition (2), occurrence of collapse during unwinding is suppressed and a high space factor can be maintained.

The disclosure of Japanese Patent Application No. 2017-025175 is incorporated by reference herein in its entirety.

All publications, patent applications, and technical standards mentioned in this specification are herein incorporated by reference to the same extent as if such individual publication, patent application, or technical standard was specifically and individually indicated to be incorporated by reference.

EXPLANATION OF SYMBOLS

10 Molten metal nozzle
20 Crucible
22A Molten alloy
22B Puddle (molten metal puddle)
22C Alloy ribbon
22F Free solidified surface
22R Roll face
30 Chill roll
40 High-frequency coil
50 Peeling gas nozzle
60 Polishing brush roll
61 Roll axis member
62 Polishing brush
100 Alloy ribbon manufacturing device
P Rotational direction of chill roll
Q Discharge direction of molten alloy
R Rotational direction of polishing brush roll

What is claimed is:

1. A method of manufacturing an Fe-based amorphous alloy ribbon, via an Fe-based amorphous alloy ribbon manufacturing device comprising:

a chill roll, wherein a coated film of a molten alloy is formed on a peripheral surface of the chill roll and is cooled on the peripheral surface to form an Fe-based amorphous alloy ribbon, wherein the molten alloy is a source material for the Fe-based amorphous alloy ribbon, a molten metal nozzle configured to discharge the molten alloy toward the peripheral surface of the chill roll, a peeling means configured to peel off the Fe-based amorphous alloy ribbon from the peripheral surface of the chill roll, a wind-up roll configured to wind the Fe-based amorphous alloy ribbon that has been peeled off, and a polishing brush roll, comprising a roll axis member and a polishing brush, the polishing brush comprising a plurality of brush bristles having tips, wherein the polishing brush roll (i) is placed around the roll axis member; (ii) is provided between the peeling means and the molten metal nozzle at a periphery of the chill roll; and, (iii) is configured to polish by bringing the polishing brush into contact with the peripheral surface of the chill roll while rotating axially in a reverse direction to the chill roll; wherein a free length of the brush bristles is more than 30 mm but no more than 50 mm, and a density of the brush bristles at the brush bristle tips is more than 0.30 bristles/$mm^2$ but no more than 0.60 bristles/$mm^2$;

the method comprising (a) forming a coated film of the molten alloy on the peripheral surface of the chill roll that has been subjected to polishing using the polishing brush roll; (b) cooling the coated film on the peripheral surface; (c) peeling off the Fe-based amorphous ribbon from the peripheral surface of the chill roll; (d) polishing the peripheral surface of the chill roll by using the polishing brush of the polishing brush roll; and, (e) winding the Fe-based amorphous alloy ribbon on the wind-up roll to obtain a wound body of the Fe-based amorphous alloy ribbon.

2. The method of claim 1, wherein:

20 sheets of early stage alloy ribbon samples and 20 sheets of end stage alloy ribbon samples are each obtained by continuously cutting every 20 mm along a longitudinal direction to cut out sheets of samples from a range of the Fe-based amorphous alloy ribbon that has been produced continuously; each of the 20 sheets of early stage alloy ribbon sample and 20 sheets of end stage alloy ribbon sample having a strip shape wherein a width direction in the Fe-based amorphous alloy ribbon corresponds to a long side and the longitudinal direction in the Fe-based amorphous alloy ribbon corresponds to a short side;

for the early stage alloy ribbon samples: (i) the range of the Fe-based amorphous alloy ribbon is produced within a time period of 5 minutes to 7 minutes after the start of production, (ii) a space factor $LF_{[EARLY]}$ is 87% to 94%, and (iii) $WC_{[EARLY]}$, which is measured with regard to a layered body prepared by disposing 20 sheets of the early stage alloy ribbon samples one on another in layers, is from 5 μm/20 sheets to 40 μm/20 sheets;

for the end stage alloy ribbon samples: (i) the range of the Fe-based amorphous alloy ribbon is 1 m from the last end formed at the time of finishing the production, (ii) a rate of change $(LF_{[END]}-LF_{[EARLY]})/LF_{[EARLY]}\times 100$ in a space factor $LF_{[END]}$ in the end stage alloy ribbon samples from the space factor $LF_{[EARLY]}$ is 2% or less, and (iii) a rate of change $(WC_{[END]}-WC_{[EARLY]})/WC_{[EARLY]}\times 100$ in $WC_{[END]}$, which is measured with regard to a layered body prepared by disposing 20 sheets of the end stage alloy ribbon samples one on another in layers, from the $WC_{[EARLY]}$ is from −12% to +80%; and, to measure a wedge coefficient (WC), with regard to each of one end IB and another end OB in a long side direction in a layered body prepared by disposing, one on another in layers, 20 sheets of alloy ribbon samples each having a strip shape, the thicknesses of three points 0 mm to 16 mm from the end, 10 mm to 26 mm from the end, and 20 mm to 36 mm from the end, are measured using a micrometer employing an anvil having a diameter of 16 mm, a greater one of a difference between a maximum value $IB_{max}$ of one end side and a minimum value $OB_{min}$ of the other end side and a difference between a minimum value $IB_{min}$ of one end side and a maximum value $OB_{max}$ of the other end side is taken as WC, wherein WC measured with regard to the early stage alloy ribbon samples is taken as $WC_{[EARLY]}$, and WC measured with regard to the end stage alloy ribbon samples is taken as $WC_{[END]}$.

3. The method of claim 2, wherein:

the Fe-based amorphous alloy ribbon consists of Fe, Si, B, C, and impurities, and a content of Si is 1.8 atom % to 4.2 atom %, a content of B is 13.8 atom % to 16.2 atom %, and a content of C is 0.05 atom % to 0.4 atom %, wherein a total content of Fe, Si, B, C, and impurities is 100 atom %.

4. The method of claim 3, wherein the content of Si is 2 atom % to 4 atom %, the content of B is 14 atom % to 16 atom %, and the content of C is 0.2 atom % to 0.3 atom %, wherein the total content of Fe, Si, B, C, and impurities is 100 atom %.

5. The method of claim 1, wherein:

the Fe-based amorphous alloy ribbon consists of Fe, Si, B, C, and impurities, and a content of Si is 1.8 atom % to 4.2 atom %, a content of B is 13.8 atom % to 16.2 atom %, and a content of C is 0.05 atom % to 0.4 atom %, wherein a total content of Fe, Si, B, C, and impurities is 100 atom %.

6. The method of claim 5, wherein the content of Si is 2 atom % to 4 atom %, the content of B is 14 atom % to 16 atom %, and the content of C is 0.2 atom % to 0.3 atom %, wherein the total content of Fe, Si, B, C, and impurities is 100 atom %.

* * * * *